US006187070B1

(12) United States Patent
Gaeta et al.

(10) Patent No.: US 6,187,070 B1
(45) Date of Patent: Feb. 13, 2001

(54) ENHANCED RADIATION CURE

(75) Inventors: Anthony C. Gaeta, Lockport; Gwo Shin Swei, East Amherst, both of NY (US)

(73) Assignee: Norton Company, Worcester, MA (US)

( * ) Notice: Under 35 U.S.C. 154(b), the term of this patent shall be extended for 0 days.

(21) Appl. No.: 09/478,398

(22) Filed: Jan. 6, 2000

(51) Int. Cl.[7] ..... C09K 3/14

(52) U.S. Cl. ..... 51/298; 51/307; 106/400; 252/600; 427/385.5; 427/496; 427/507; 427/508; 427/521; 427/557; 427/558; 427/559

(58) Field of Search ..... 106/400; 427/496, 427/507, 521, 508, 557, 558, 559, 385.5; 252/600; 51/298, 307

(56) References Cited

U.S. PATENT DOCUMENTS

| | | | | |
|---|---|---|---|---|
| 4,547,204 | | 10/1985 | Caul | 51/295 |
| 4,773,920 | | 9/1988 | Chasman et al. | 51/295 |
| 4,822,471 | * | 4/1989 | MacDonald . | |
| 5,014,468 | | 5/1991 | Ravipati et al. | 51/295 |

* cited by examiner

*Primary Examiner*—Bernard Pianalto
(74) *Attorney, Agent, or Firm*—David Bennett

(57) ABSTRACT

Production of a finished fabric backing for use in the production of a coated abrasive is performed using a dual cure system comprising a radiation curable binder and a thermal initiator in which polymerization is initiated by the use of radiation until the exotherm produced raises the temperature of the formulation to the activation temperature of the thermal initiator. Thereafter the polymerization continues under the influence of the thermal initiator alone.

5 Claims, No Drawings

ENHANCED RADIATION CURE

BACKGROUND TO THE INVENTION

The present invention relates to the preparation of coated abrasive materials comprising a curable binder and specifically to formulations for finishing fabric substrates that are curable by radiation.

The use of radiation curable formulations in the preparation of coated abrasives has been taught for many years. One of the earliest examples of this form of binder is described in U.S. Pat. No. 4,547,204 which describes radiation curing urethane acrylates and epoxy acrylates using electron beam radiation. In addition U.S. Pat. No. 4,773,920 taught the use of binder/grain mixtures curable by radiation-induced free radical polymerization. In U.S. Pat. No. 5,014,468 the problems of UV radiation-induced polymerization are reviewed in the context of coated abrasives. It is pointed out that, in view of the limited penetration of the UV light into a formulation that comprises pigment and/or relatively coarse abrasive particles, UV radiation is somewhat limited in its utility to relatively thin layers. On the other hand, electron beam induced polymerization can induce deterioration in some substrates if they are exposed to high dose levels, (10 to 12 Mrads) in an effort to cure thick coatings or coatings with a high level of abrasive or filler.

The problems limiting the applicability of radiation-cured polymers in coated abrasives are experienced at their most intense in finishing formulations. These are formulations added to fabric materials to prepare them to receive maker coats in the preparation of coated abrasives. Typically they comprise polymers and fillers intended to saturate the backing and provide a surface to which the maker coat will bond tightly. If the backing is too porous much of the maker will be absorbed into the body of the backing rendering it useless for the purpose of anchoring the abrasive grain when this is applied. Hence binders with a very significant amounts of filler are typically used. The filler is a necessary component to reduce the cost, block the passages within the fabric to reduce its porosity and to modify the physical properties of the backing.

In particular, the addition of filler improves the modulus of the cured formulation and at the same time reduces the amount of the (usually expensive) polymer-forming components that comprise the binder. Thus fillers are often preferred components also of maker and size coats.

The presence of heavy filler loadings is very unfavorable to the use of UV-radiation curable binders because, unless fillers are used that are transparent to the UV radiation, the UV radiation cannot penetrate far enough because of the shadowing effect of the filler particles. Electron beam radiation is effective but if a high dosage is required to penetrate the formulation, there is a strong risk of damage to the substrate.

Thus in spite of the obvious advantages of radiation-curable formulations in terms of speed of cure, such products have had difficulty moving out of the niche markets to which they are particularly well adapted, such as fining pads and abrasive discs for optical applications.

A method has now been found for curing finishes applied to a fabric using a radiation treatment so as to effect rapid cure of the finish without significant damage to the substrate fabric. This process significantly speeds up the production of coated abrasives which, using conventional techniques, is fraught with delays imposed by the need for gradual and cautious cure of the binders currently used at all stages of the production.

The present invention provides a formulation suitable for use in filling a backing material or substrate for use in the production of a coated abrasive.

The formulation includes a binder that is radiation-curable and produces adequate cure in a relatively short time despite the presence of significant amounts of fillers and/or pigments.

GENERAL DESCRIPTION OF THE INVENTION

The present invention provides a polymerizable formulation that is stable under ambient conditions, (which are understood to be atmospheric pressure and a temperature below about 20° C.), comprising a filler, a radiation-curable compound and a promoter capable of promoting free-radical polymerization of the compound at a temperature below that generated in the formulation by radiation-initiated polymerization of the compound.

A second aspect of the invention provides a process for the production of a backing material suitable for use in the production of a coated abrasive which comprises:

a) treating a fabric with a finishing formulation comprising a filler, a radiation-curable binder compound that is polymerizable by a free-radical polymerization mechanism and a promoter that promotes free-radical polymerization of the binder compound at a temperature below that generated in the formulation by the radiation-induced polymerization of the binder compound but is substantially inactive at ambient temperatures;

b) initiating polymerization of the binder using radiation such that the temperature of at least part of the formulation is raised above that at which the promoter is activated; and c) continuing the polymerization under the influence of the promoter.

In a preferred process according to this aspect of the invention, the radiation is discontinued once the activation temperature of the promoter has been reached and polymerization continues to substantial completion without further radiation treatment.

The most frequently used fillers are calcium carbonate, talc, clays such as kaolin, gypsum, magnesium carbonate, alumina hydrates and silica. Any of these as well as other suitable filler materials can be used in the present invention. However if UV radiation is used to initiate curing, the filler is preferably one that is substantially transparent to UV light, such as alumina trihydrate.

DETAILED DESCRIPTION OF THE INVENTION

The finishing formulation of the invention preferably contains from 0 to about 60% by weight, and more preferably from 0 to 25% by weight, of a filler. In addition to the filler it is possible to add other additives such as colorants, anti-static additives, surfactants and other additives adapted to permit more efficient penetration and coverage of the fabric to which it is applied.

The fabric used is frequently a woven fabric but in many instances a non-woven, stitch-bonded or knitted fabric may be preferred. All however share to a greater or lesser degree the characteristic of porosity and require the application of a finishing treatment to reduce such porosity before they can be used efficiently as backings for coated abrasives. The finishing process provides a means to obtain good adhesion to the fabric and the required body retention, which allows the abrasive product to function under a wide range of conditions.

The promoter suitable for use in the formulation is one that is inactive at the temperature at which the formulation is stored or used during the electron beam radiation induced polymerization. In practice this means that the promoter is inactive a temperatures below about 25° C. and are preferably not activated until a temperature in excess of about 30° C. is reached.

Promoters are often classified by their "ten hour half life temperature" which is the temperature at which half the promoter will have become inactive after ten hours exposure to that temperature. This temperature will be referred to hereafter as the "activation temperature". In this context, the preferred promoters are those with a ten hour half life temperature of at least 50° C. and more preferably more than about 70° C.

Suitable promoters, (with their ten hour half lives indicated in parentheses) include: t-butyl hydroperoxide (172° C.); t-butyl peroxide (127° C.); t-amyl peroxide (100° C.); caprylyl peroxide (63° C.); dicumyl peroxide (117° C.); and lauryl peroxide (62° C.). Other promoters such as the following can be used providing always that the during the cure process the temperature can be elevated above the activation temperature: t-butyl peroxybenzoate, (107° C.); t-amyl peroxyacetate (100° C.); t-butyl peroctoate (73° C.); and azo compounds such as azobisisobutyronitrile (about 65° C.).

Such promoters are activated by heat so that it is important that the exotherm generated by the radiation induced polymerization of the binder be sufficient to raise the temperature of at least a portion of the formulation above the activation temperature of the promoter.

In the event that the promoter has a ten hour half life temperature towards the lower end of the preferred range, it is possible to meter the promoter into the system at the same time as, or shortly before, the application of the formulation to the substrate. This introduces a level of complexity that is usually not necessary and is therefore not generally preferred.

When electron beam radiation is used the intensity of the electron beam radiation is sufficient to initiate polymerization at the required level but insufficient to cause damage to the substrate. The level at which damage is usually anticipated is above about 10 Mrads. Some substrates such as those made up of cellulosic fibers are particularly sensitive to such damage and when using these substrates it may be desirable to use promoters that are activated at the low end of the permitted range to minimize the amount of radiation exposure required to raise the temperature of the formulation to the activation temperature of the promoter. Alternatively UV-radiation may be the preferred polymerization initiator.

Generally where electron beam radiation is used, the amount can be from 1 to 10 Mrads and more preferably from 3 to 8 Mrads.

The radiation-polymerizable binder may be any one of those generally know in the art as useful in such applications. These include (meth)acrylates, (including polyacrylates); epoxy-(meth)acrylates; urethane(meth) acrylates; unsaturated polyesters; and isocyanurates. The fillers chosen for the formulations according to the invention include calcium carbonate;

aluminum oxide, (particularly the trihydrate); talc; crushed gypsum; silica and magnesium carbonate. The preferred filler in terms of purity and cost of the materials available is often calcium carbonate. However as was indicated above, when UV radiation is used to initiate the polymerization, the preferred filler is aluminum trihydrate.

The preferred binder formulations according to the invention comprise from 40 to 99.9 wt % of a polymerizable binder; from 0 to 60 wt % of a filler; and from 0.1 to 5 wt % of the promoter. Particularly preferred formulations comprise from 60 to 99.75 wt % of the binder; from 0 to 40 wt % of the filler; and from 0.25 to 3 wt % of the promoter.

DESCRIPTION OF THE PREFERRED EMBODIMENTS

The present invention is now illustrated with reference to the following Example which is for the purpose of illustration only and is not intended to convey any necessary limitation on the essential scope of the invention.

In each of the four formulations described below, a binder formulation comprising 30% by weight of an acrylated epoxy oligomer available from UCB Radcure Inc. under the registered trade mark EBECRYLO 3700 and 30% by weight of trimethylolpropane triacrylate, to which had been added 1% by weight of the formulation of a photoinitiator. A thermal initiator, (t-butyl peroxybenzoate), was also added in an amount of 0.25% by weight of the formulation, to formulations according to the invention. In half of the formulations, 25% by weight (based on the formulation weight) of a filler, aluminum trihydrate, was also added. Thus the four formulations tested comprised two without the thermal initiator and two with the thermal initiator. In each pair one had aluminum trihydrate, (ATH), as a filler and the other did not.

Each formulation was spread uniformly on a carrier web moving under a UV source at 50 linear feet per minute. The UV cure was effected using a Fusion "D" bulb generating 300 watts/inch. After passage through the UV cure treatment, the depth of the cure was measured and recorded.

It is apparent that the presence of the ATH in the formulations containing no thermal initiator reduced the depth of cure by more than 50%. The formulations containing the thermal initiator, (which was clearly activated by the heat generated by the UV cure process), cured to a depth that was at least 100% greater than was observed for formulations lacking the thermal initiator. What is more, the formulation containing the ATH as well as the thermal initiator cured to an even greater depth. This was a surprising and highly desirable result.

It is therefore shown that, providing the temperature reached during the UV cure process reaches a level above the activation temperature of the thermal initiator, cure to a much greater depth is achievable with the presence of a thermal initiator. The heat can be generated by the exothermic polymerization reaction of the formulation components under the influence of UV radiation possibly augmented by the radiant heat naturally emitted by the UV source.

What is claimed is:

1. A cloth-finishing formulation that is stable under ambient conditions comprising from 25 to 60% by weight, based on the formulation weight of a filler and from 40 to 75% by weight, based on the formulation weight of a binder material which comprises a radiation-polymerizable compound and from 0.1 to 5% by binder material weight of a thermal initiator for the polymerization of the compound which is activated at temperatures above about 25° C. but below the temperatures reached during the radiation-induced polymerization.

2. A formulation according to claim 1 which comprises from about 30 to about 40% by weight of the filler.

3. A formulation according to claim 1 in which the binder material comprises a thermal initiator selected from the group consisting of: t-butyl peroxybenzoate; t-amyl hydroperoxide; caprylyl peroxide; dicumyl peroxide; di-t-butyl peroxide; and lauryl peroxide and mixtures thereof.

4. A formulation according to claim 1 in which the amount of the thermal initiator is from 0.25 to 3% by weight of the binder material.

5. A formulation according to claim 1 in which the radiation-polymerizable binder compound is selected from the group consisting of: (meth)acrylates, polyacrylates; epoxy-(meth)acrylates; urethane(meth)acrylates; unsaturated polyesters; and isocyanurates.

* * * * *